US008556607B2

(12) United States Patent
Izawa et al.

(10) Patent No.: US 8,556,607 B2
(45) Date of Patent: Oct. 15, 2013

(54) SCREW ROTOR

(75) Inventors: Yuya Izawa, Aichi-ken (JP); Shinya Yamamoto, Aichi-ken (JP); Masahiro Inagaki, Aichi-ken (JP); Makoto Yoshikawa, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 396 days.

(21) Appl. No.: 12/837,575

(22) Filed: Jul. 16, 2010

(65) Prior Publication Data

US 2011/0020162 A1 Jan. 27, 2011

(30) Foreign Application Priority Data

Jul. 22, 2009 (JP) ..... 2009-171114

(51) Int. Cl.
*F01C 21/10* (2006.01)

(52) U.S. Cl.
USPC ..... 418/150; 418/9; 418/206.5

(58) Field of Classification Search
USPC ..... 418/203.1, 206.1, 206.5, 150, 9, 201.1
See application file for complete search history.

(56) References Cited

U.S. PATENT DOCUMENTS

2008/0025858 A1 * 1/2008 Hwang et al. ..... 418/10

FOREIGN PATENT DOCUMENTS

| | | | |
|---|---|---|---|
| JP | 57068576 A | * | 4/1982 |
| JP | 63-59031 | | 11/1988 |
| JP | 3-111690 | | 5/1991 |
| JP | 2008-38861 | | 2/2008 |
| WO | WO 2008029759 A1 | * | 3/2008 |

* cited by examiner

*Primary Examiner* — Kenneth Bomberg
*Assistant Examiner* — Jessica Kebea
(74) *Attorney, Agent, or Firm* — Greenblum & Bernstein, P.L.C.

(57) ABSTRACT

A screw rotor is for use in a screw pump that pumps fluid by rotation of a pair of screw rotors engaged with each other in a rotor housing. The screw rotor includes a multiple-thread portion for pump suction side and a single-thread portion for pump discharge side. The screw rotor is formed so that the tooth profile of the multiple-thread portion is connected to the tooth profile of the single-thread portion through a boundary plane that is perpendicular to the rotation axis of the screw rotor. The first curved portion coincides with the third curved portion in the boundary plane.

5 Claims, 10 Drawing Sheets

SCREW ROTOR

BACKGROUND OF THE INVENTION

The present invention relates to a screw rotor for use in a screw pump that pumps fluid by rotation of a pair of screw rotors engaged with each other in the screw pump.

Japanese Unexamined Patent Application Publication No. 2008-38861 discloses a screw pump having a pair of single-thread screw rotors engaged with each other. The lead angle of the screw rotor on the suction side of the pump is larger than that on the discharge side of the pump, which is suitable for fluid transfer with increased amount of suction. However, the number of turns is less on the suction side of the screw rotor with large lead angle, which affects rotational balance of the screw rotor.

Japanese Examined Patent Application Publication No. 63-59031 discloses another screw pump having a pair of multiple-thread screw rotors engaged with each other. In such screw pump, the problem with rotational balance, as in the case of the single-thread screw rotor, does not occur.

However, when the number of turns on the discharge side of the screw rotor with small lead angle is increased, for example, in a double-thread screw rotor, its tooth thickness is approximately half of that of a single-thread screw rotor, under the condition of the same lead and the same fluid transfer volume. In such a case, sealing length between the inner surface of the rotor housing and the tooth is approximately half of that of a single-thread screw rotor, which leads to reduced sealing performance.

Japanese Unexamined Patent Application Publication No. 3-111690 discloses still another screw pump having a multiple-thread screw rotor on the suction side and a single-thread screw rotor on the discharge side. The multiple-thread screw rotor is located concentrically to the single-thread screw rotor. In such screw pump, the problem with rotational balance as in the case of the single-thread screw rotor does not occur, and the problem with sealing as in the case of the double-thread screw rotor does not occur, either.

However, in the screw pump disclosed in the publication No. 3-111690, since the multiple-thread screw rotor is axially spaced apart from the single-thread screw rotor, the volume of the fluid transfer space is increased at the part where the number of threads is changed. Such volume increase causes an expansion of the transferred fluid, which leads to inefficient pumping operation of the screw pump.

The present invention is directed to providing a screw rotor that prevents inefficient pumping operation of a screw pump while maintaining a good rotational balance of the screw rotor and ensuring sealing performance.

SUMMARY OF THE INVENTION

In accordance with an aspect of the present invention, a screw rotor is for use in a screw pump (11) that pumps fluid by rotation of a pair of screw rotors (13, 14) engaged with each other in a rotor housing (12). The screw rotor (13, 14) includes a multiple-thread portion (26, 34) for pump suction side and a single-thread portion (29, 37) for pump discharge side. The single-thread portion (29, 37) has a tooth profile (G11, G12) in an imaginary plane that is perpendicular to the rotation axis (151, 161) of the screw rotor (13, 14). The tooth profile (G11, G12) of the single-thread portion (29, 37) includes: a tooth top portion (A1B1, A2B2) extending circularly around the rotation axis (151, 161); a tooth bottom portion (C1D1, C2D2) extending circularly around the rotation axis (151, 161), the radius of the tooth bottom portion (C1D1, C2D2) being smaller than the radius of the tooth top portion (A1B1, A2B2); a first curved portion (A1C1, A2C2) formed by a trochoidal curve, the first curved portion (A1C1, A2C2) connecting one end (A1, A2) of the tooth top portion (A1B1, A2B2) to one end (C1, C2) of the tooth bottom portion (C1D1, C2D2); and a second curved portion (B1D1, B2D2) connecting the other end (B1, B2) of the tooth top portion (A1B1, A2B2) to the other end (D1, D2) of the tooth bottom portion (C1D1, C2D2). The multiple-thread portion (26, 34) has a tooth profile (G21, G22) in an imaginary plane that is perpendicular to the rotation axis (151, 161) of the screw rotor (13, 14). The tooth profile (G21, G22) of the multiple thread portion (26, 34) includes: a tooth top portion (42A, 42B) extending circularly around the rotation axis (151, 161); a tooth bottom portion (43A, 43B) extending circularly around the rotation axis (151, 161), the radius of the tooth bottom portion (43A, 43B) being smaller than the radius of the tooth top portion (42A, 42B); and a third curved portion (46A, 46B) formed by a trochoidal curve, the third curved portion (46A, 46B) connecting one end (422A, 422B) of the tooth top portion (42A, 42B) to one end of the tooth bottom portion (43A, 43B). The screw rotor (13, 14) is formed so that the tooth profile (G21, G22) of the multiple-thread portion (26, 34) is connected to the tooth profile (G11, G12) of the single-thread portion (29, 37) through a boundary plane (38, 39) that is perpendicular to the rotation axis (151, 161) of the screw rotor (13, 14). The first curved portion (A1C1, A2C2) satisfies the following condition (1) or (2):

(1) the first curved portion (A1C1, A2C2) coincides with the third curved portion (46A, 46B) in the boundary plane (38, 39);

(2) the first curved portion (A1C1, A2C2) is angularly spaced from the third curved portion (46A, 46B) by an angular difference $\alpha o$ in the direction opposite to the rotation direction (W, Z) of the screw rotor (13, 14), and the angular difference $\alpha o<\theta$ is satisfied, where $\theta$ is a tooth top portion angle between the line (L11, L21) extending from the one end (422A, 422B) of the tooth top portion (42A, 42B) of the multiple-thread portion (26, 34) to the rotation axis (151, 161) of the screw rotor (13, 14) and the line (L12, L22) extending from the other end (421A, 421B) of the tooth top portion (42A, 42B) of the multiple-thread portion (26, 34) to the rotation axis (151, 161) of the screw rotor (13, 14) in the boundary plane (38, 39).

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

Figure 1:
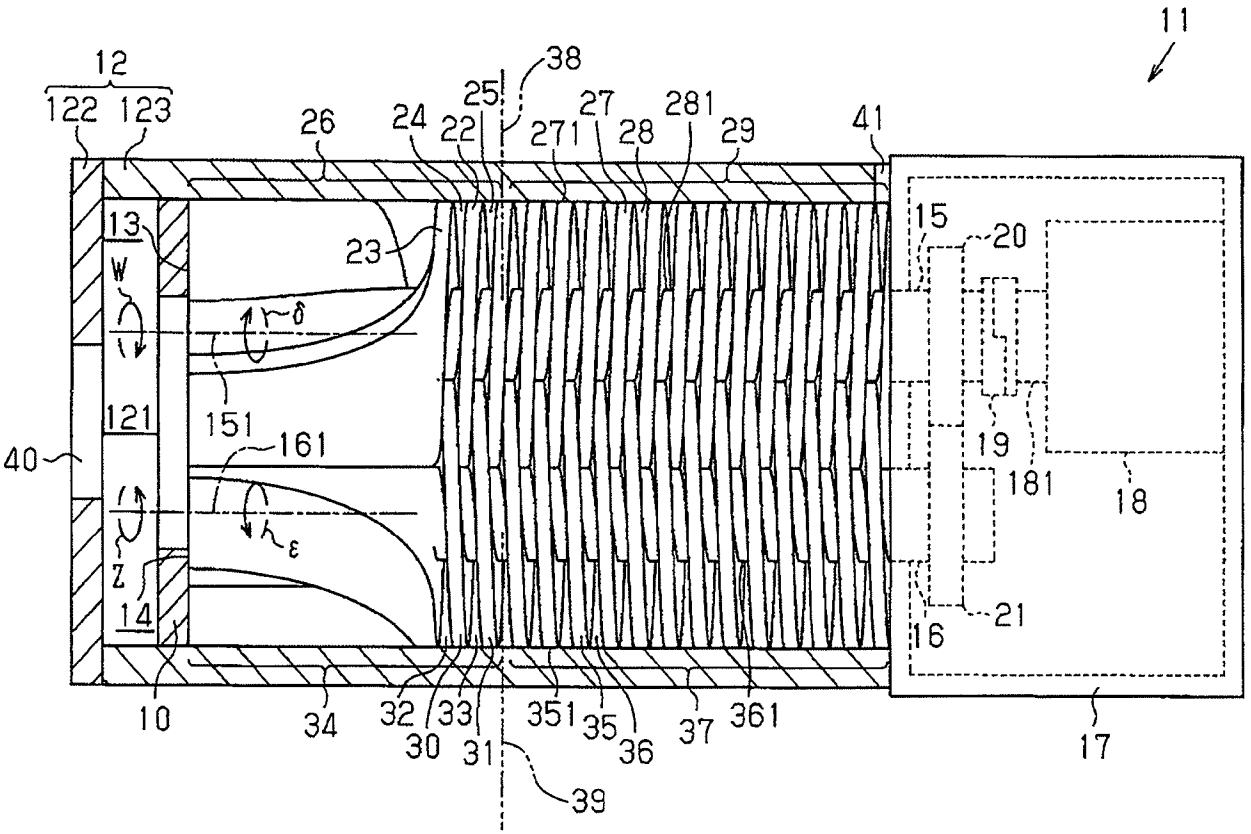
FIG. 1 is a longitudinal sectional view of a screw pump having a first screw rotor and a second screw rotor according to a first embodiment of the present invention.

Referring to FIG. 1, a screw pump 11 has a rotor housing 12 in which a first screw rotor 13 and a second screw rotor 14 are provided rotatably. The shaft 15 of the first screw rotor 13 and the shaft 16 of the second screw rotor 14 extend into a motor housing 17 of the screw pump 11 where an electric motor 18 is accommodated. Driving force generated by the electric motor 18 is transmitted through its output shaft 181 and the coupling 19 to the shaft 15, thus rotating the shaft 15. The rotating motion of the shaft 15 is transmitted to the other shaft 16 through a pair of gears 20 and 21 engaged with each other, so that the shaft 16 is rotated in the direction opposite to the shaft 15. The first screw rotor 13 is rotated in the direction indicated by arrow W, and the second screw rotor 14 is rotated in the direction indicated by arrow Z opposite to the arrow direction W.

Figure 2:
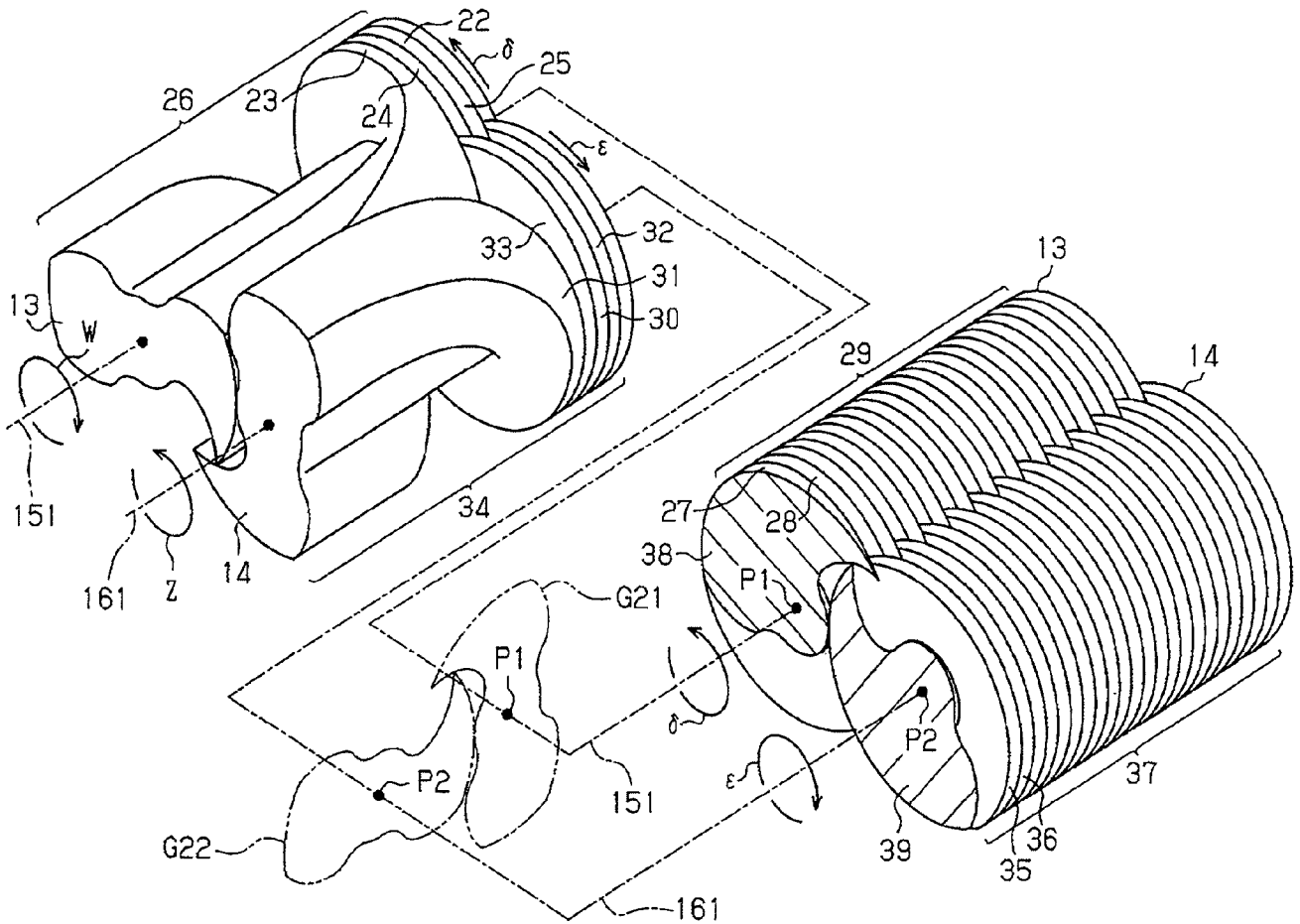
FIG. 2 is a perspective view of the first screw rotor and the second screw rotor of FIG. 1.

Referring to FIG. 2, the first screw rotor 13 includes a double-thread portion 26 (multiple-thread portion) and a single-thread portion 29. The double-thread portion 26 has two helical teeth 22, 23 and two helical grooves 24, 25. The single-thread portion 29 has one helical tooth 27 and one helical groove 28. Similarly, the second screw rotor 14 includes a double-thread portion 34 (multiple-thread portion) and a single-thread portion 37. The double-thread portion 34 has two helical teeth 30, 31 and two helical grooves 32, 33. The single-thread portion 37 has one helical tooth 35 and one helical groove 36.

The helical teeth 22, 23 of the double-thread portion 26 of the first screw rotor 13 are engaged with the helical teeth 30, 31 of the double-thread portion 34 of the second screw rotor 14 with the helical teeth 22, 23 inserted in the helical grooves 32, 33 of the double-thread portion 34 of the second screw rotor 14 and the helical teeth 30, 31 inserted in the helical grooves 24, 25 of the double-thread portion 26 of the first screw rotor 13.

The helical tooth 27 of the single-thread portion 29 of the first screw rotor 13 is engaged with the helical tooth 35 of the single-thread portion 37 of the second screw rotor 14 with the helical tooth 27 inserted in the helical groove 36 of the single-thread portion 37 of the second screw rotor 14 and the helical tooth 35 inserted in the helical groove 28 of the single-thread portion 29 of the first screw rotor 13.

Referring to FIG. 1, in the first screw rotor 13, the double-thread portion 26 is formed continuously with the single-thread portion 29 through a boundary plane 38. The double-thread portion 26 is located on the suction side of the screw pump 11, and the single-thread portion 29 is located on the discharge side of the screw pump 11. In the second screw rotor 14, the double-thread portion 34 is formed continuously with the single-thread portion 37 through a boundary plane 39. The double-thread portion 34 is located on the suction side of the screw pump 11, and the single-thread portion 37 is located on the discharge side of the screw pump 11. The boundary planes 38, 39 lie in the same imaginary plane that is perpendicular to the rotation axes 151, 161 of the first and second screw rotors 13, 14.

The rotor housing 12 is formed by an end wall 122 and a peripheral wall 123. The rotor housing 12 has on one end thereof an inlet 40 formed through the end wall 122 so as to communicate with the suction chamber 121 defined in the rotor housing 12. A cover plate 10 is provided in the suction chamber 121 so as to cover part of the end surfaces of the first and second screw rotors 13, 14. The rotor housing 12 has on the other end thereof an outlet 41 formed through the peripheral wall 123 so as to communicate with the interior space of the rotor housing 12.

Fluid is introduced through the inlet 40 into the suction chamber 121 with the rotation of the first and second screw rotors 13, 14. The fluid is introduced into the transfer space at a given timing due to the presence of the cover plate 10, transferred in the helical groove toward the outlet 41, then discharged out of the screw pump 11 through the outlet 41.

Figure 3:
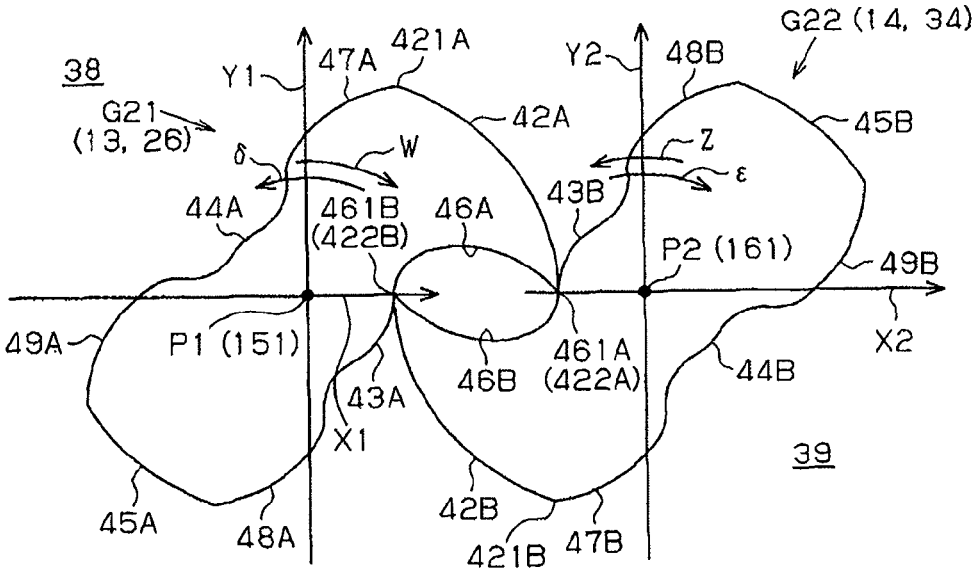
FIG. 3 shows tooth profiles of double-thread portions of the first and second screw rotors of FIGS. 1 and 2.
Figure 4:
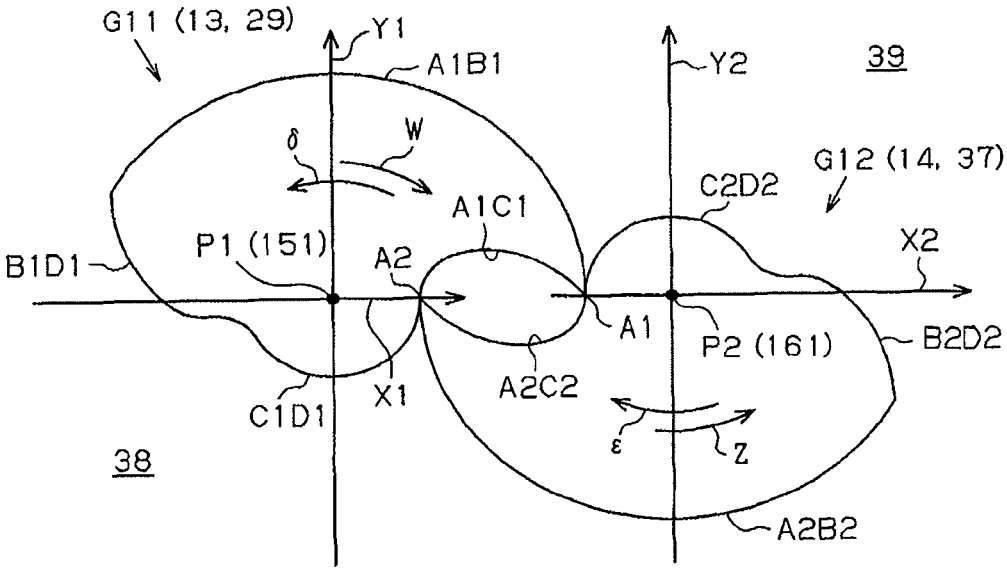
FIG. 4 shows tooth profiles of single-thread portions of the first and second screw rotors of FIGS. 1 and 2.

FIG. 3 shows a tooth profile G21 of the double-thread portion 26 of the first screw rotor 13 and a tooth profile G22 of the double-thread portion 34 of the second screw rotor 14. FIG. 4 shows a tooth profile G11 of the single-thread portion 29 of the first screw rotor 13 and a tooth profile G12 of the single-thread portion 37 of the second screw rotor 14. The tooth profile of the first screw rotor 13 is the profile of the first screw rotor 13 in an imaginary plane that is perpendicular to the rotation axis 151, and similarly the tooth profile of the second screw rotor 14 is the profile of the second screw rotor 14 in an imaginary plane that is perpendicular to the rotation axis 161.

The thread direction of the first screw rotor 13 (indicated by arrow $\delta$ in FIGS. 3 and 4) is opposite to the rotation direction W of the first screw rotor 13. The thread direction of the second screw rotor 14 (indicated by arrow $\epsilon$ in FIGS. 3 and 4) is opposite to the rotation direction Z of the second screw rotor 14.

The thread direction $\delta$ of the first screw rotor 13 is opposite to the thread direction $\epsilon$ of the second screw rotor 14.

The following will describe in detail the tooth profiles G11, G12 of the single-thread portions 29, 37 of the first and second screw rotors 13, 14.

Figure 5:
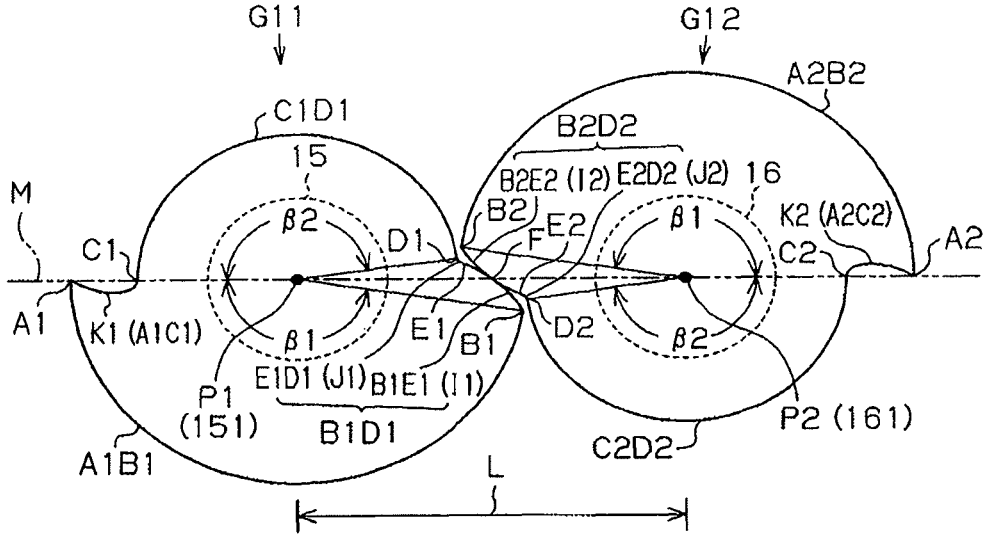
FIG. 5 shows the tooth profiles of the single-thread portions in detail.

Referring to FIG. 5, the symbol P1 denotes the point on the central axis of the shaft 15 (i.e., the rotation axis 151 of the first screw rotor 13), and the symbol P2 denotes the point on the central axis of the shaft 16 (i.e., the rotation axis 161 of the second screw rotor 14). These points P1, P2, that is, the rotation centers of the first and second screw rotors 13, 14, will be hereinafter referred to as the central points P1, P2. The symbol L denotes the distance between the central points P1 and P2 (i.e., the distance between the central axes of the shafts 15 and 16).

As shown in FIG. 5, the tooth profile G11 of the single-thread portion 29 of the first screw rotor 13 includes a tooth top portion A1B1 and a tooth bottom portion C1D1. The tooth top portion A1B1 extends circularly from point A1 to point B1 about the central point P1. The tooth bottom portion C1D1 extends circularly from point C1 to point D1 about the central point P1. The radius of the tooth bottom portion C1D1 is smaller the radius of the tooth top portion A1B1. The tooth profile G11 further includes a first curved portion A1C1 and a second curved portion B1D1. The first curved portion A1C1 connects one end A1 of the tooth top portion A1B1 to one end C1 of the tooth bottom portion C1D1. The second curved portion B1D1 connects the other end B1 of the tooth top portion A1B1 to the other end D1 of the tooth bottom portion C1D1. The first curved portion A1C1 is formed by a trochoidal curve and hereinafter referred to also as first trochoidal curve A1C1.

The tooth profile G12 of the single-thread portion 37 of the second screw rotor 14 includes a tooth top portion A2B2 and a tooth bottom portion C2D2. The tooth top portion A2B2 extends circularly from point A2 to point B2 about the central point P2. The tooth bottom portion C2D2 extends circularly from point C2 to point D2 about the central point P2. The radius of the tooth bottom portion C2D2 is smaller the radius of the tooth top portion A2B2. The tooth profile G12 further includes a first curved portion A2C2 and a second curved portion B2D2. The first curved portion A2C2 connects one end A2 of the tooth top portion A2B2 to one end C2 of the tooth bottom portion C2D2. The second curved portion B2D2 connects the other end B2 of the tooth top portion A2B2 to the other end D2 of the tooth bottom portion C2D2. The first curved portion A2C2 is formed by a trochoidal curve and hereinafter referred to also as first trochoidal curve A2C2.

In FIG. 5, the one end A1 of the tooth top portion A1B1 and the one end A2 of the tooth top portion A2B2 lie on the imaginary line M passing through the central points P1 and P2.

The first trochoidal curve A1C1 of the first screw rotor 13 is created by the one end A2 of the tooth top portion A2B2 of the second screw rotor 14. The first trochoidal curve A2C2 of the second screw rotor 14 is created by the one end A1 of the tooth top portion A1B1 of the first screw rotor 13.

The second curved portion B2D2 of the second screw rotor 14 is formed by an involute curve B2E2 connecting to the other end B2 of the tooth top portion A2B2 and a second trochoidal curve E2D2. The involute curve B2E2 is obtained from a base circle the center of which is the central point P2. The second trochoidal curve E2D2 is created by the other end B1 of the tooth top portion A1B1 of the first screw rotor 13.

The second curved portion B1D1 of the first screw rotor 13 is formed by an involute curve B1E1 connecting to the other end B1 of the tooth top portion A1B1 and a second trochoidal curve E1D1. The involute curve B1E1 is obtained from a base circle the center of which is the central point P1 and the radius of which is smaller than half of the distance L (L/2). The second trochoidal curve E1D1 is created by the other end B2 of the tooth top portion A2B2 of the second screw rotor 14.

The tooth profile G12 of the single-thread portion 37 of the second screw rotor 14 is identical to the tooth profile G11 of the single-thread portion 29 of the first screw rotor 13.

In the present embodiment, the angle β1 of the tooth top portion A1B1 of the first screw rotor 13 about the central point P1 is smaller than 180 degree. The angle β2 of the tooth bottom portion C1D1 about the central point P1 is also smaller than 180 degree and equal to the angle β1.

Similarly, the angle of the tooth top portion A2B2 of the second screw rotor 14 about the central point P2 is β1, and the angle of the tooth bottom portion C2D2 about the central point P2 is β2 that is equal to β1.

The following will describe how to create the tooth profiles G11, G12 of the single-thread portions 29, 37 of the first and second screw rotors 13, 14.

Figure 6:
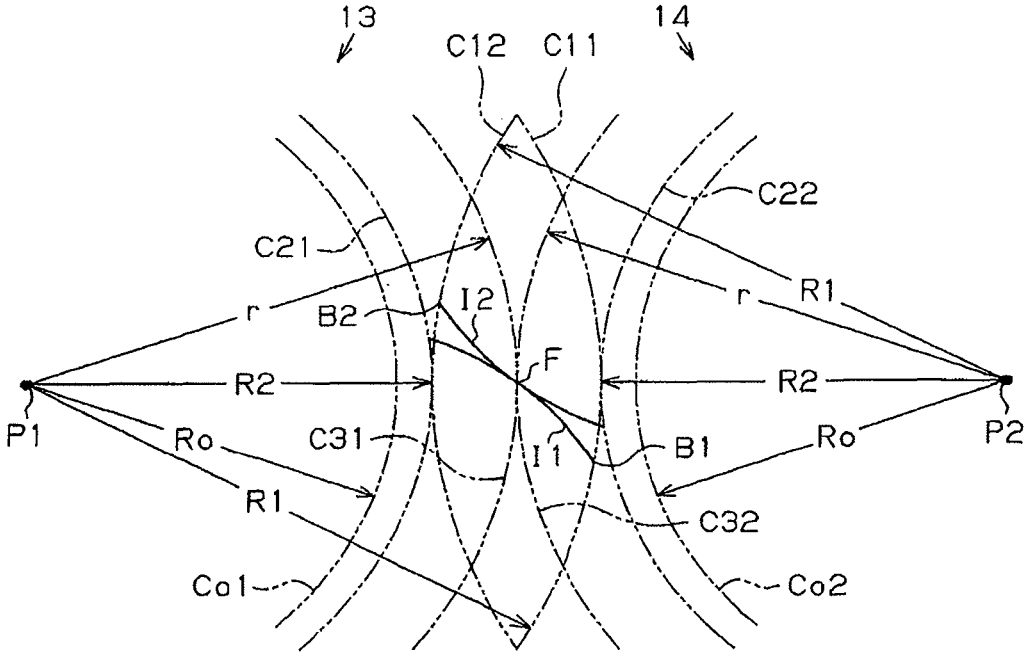
FIG. 6 is a schematic diagram explaining how to determine an involute curve.
Figure 7:
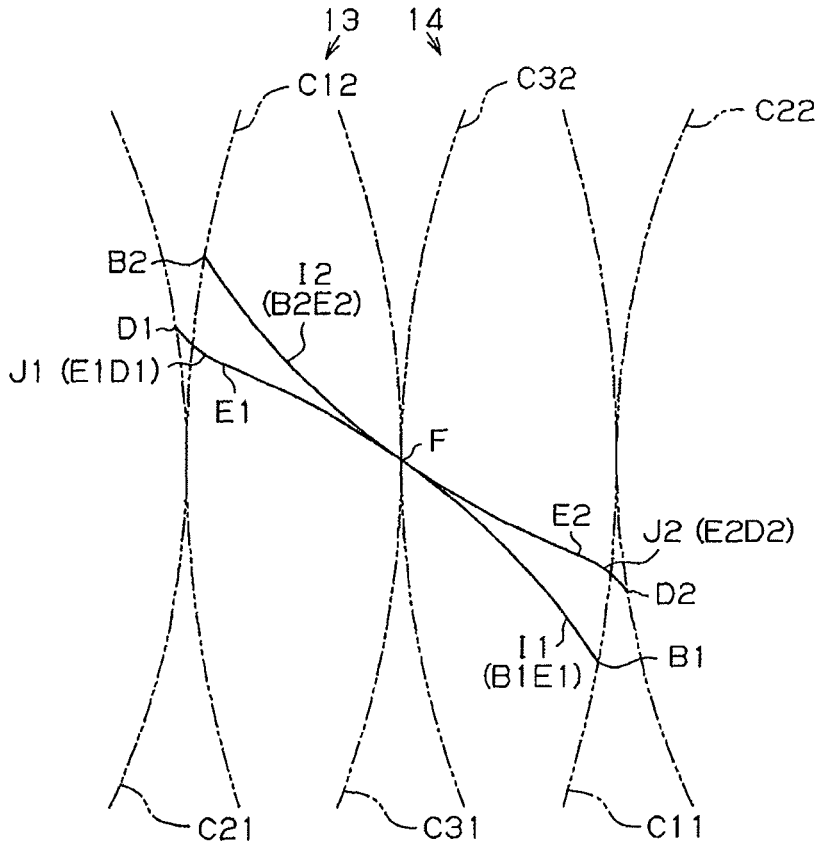
FIG. 7 is a schematic diagram explaining how to determine an involute curve and a trochoidal curve.
Figure 8:
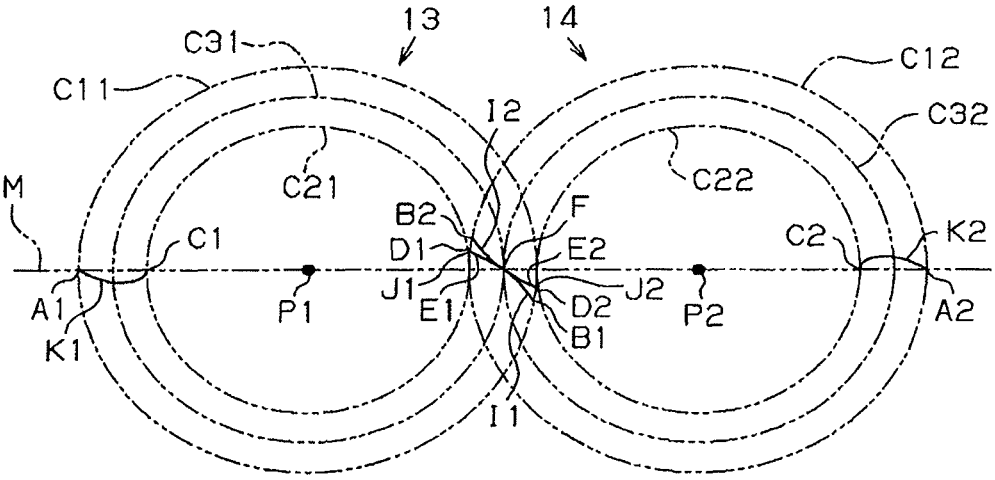
FIG. 8 is a schematic diagram explaining how to determine a trochoidal curve.

It is noted that reference numerals 13 and 14 in FIGS. 6 through 8 denotes the side of the first screw rotor 13 and the side of the second screw rotor 14, respectively.

Referring to FIG. 6, firstly, the distance between the central points P1 and P2 (i.e., distance L) is determined. The symbols C31, C32 denote the pitch circles each having a radius r (=L/2) and in contact with each other at the point F that is the middle point between the central points P1 and P2. Next, an outer circle C11 with the radius R1 that is larger than r and an inner circle C21 with the radius R2 that is smaller than r are determined. The distance L is the sum of the radius R1 and the radius R2. The pitch circle C31 is associated with the first screw rotor 13, and the pitch circle C32 is associated with the second screw rotor 14.

Next, an involute curve I1 passing through the point F is determined based on a base circle Co1 the center of which is the central point P1 and the radius of which is smaller than that of the pitch circle C31. The intersection of the involute curve I1 with the outer circle C11 on the first screw rotor 13 is the point B1 that corresponds to the aforementioned other end B1 of the tooth top portion A1B1 of the first screw rotor 13.

Similarly, an involute curve I2 passing through the point F is determined based on a base circle Co2 the center of which is the central point P2 and the radius of which is smaller than that of the pitch circle C32. The intersection of the involute curve I2 with the outer circle C12 on the second screw rotor 14 is the point B2 that corresponds to the aforementioned other end B2 of the tooth top portion A2B2 of the second screw rotor 14. Both of the base circles Co1, Co2 have the radius Ro that is smaller than the radius r of the pitch circles C31, C32.

Referring now to FIG. 7, a curve J1 is determined. The curve J1 is the trajectory of the point B2 on the outer circle C12 that is described when the first and second screw rotors 13, 14 are rotated. The curve J1 is a trochoidal curve created by rolling the second screw rotor 14 around the first screw rotor 13 with the pitch circle C32 kept in contact with the pitch circle C31. The intersection D1 of the trochoidal curve J1 with the inner circle C21 corresponds to the aforementioned other end D1 of the tooth bottom portion C1D1 of the first screw rotor 13. The trochoidal curve J1 is connected to the involute curve 11 at point E1. The involute curve B1E1 in the first screw rotor 13 is formed by the involute curve I1 extending from the point B1 to the point E1, and the second trochoidal curve E1D1 in the first screw rotor 13 is formed by the trochoidal curve J1 extending from the point E1 to the point D1. The tangent to the second trochoidal curve E1D1 coincides with the tangent to the involute curve B1E1 at the connection point therebetween.

Similarly, a curve J2 is determined. The curve J2 is the trajectory of the point B1 on the outer circle C11 that is described when the first and second screw rotors 13, 14 are rotated. The curve J2 is a trochoidal curve created by rolling the first screw rotor 13 around the second screw rotor 14 with the pitch circle C31 kept in contact with the pitch circle C32. The intersection D2 of the trochoidal curve J2 with the inner circle C22 corresponds to the aforementioned other end D2 of the tooth bottom portion C2D2 of the second screw rotor 14. The trochoidal curve J2 is connected to the involute curve I2 at point E2. The involute curve B2E2 in the second screw rotor 14 is formed by the involute curve I2 extending from the point B2 to the point E2, and the second trochoidal curve E2D2 in the second screw rotor 14 is formed by the trochoidal curve J2 extending from the point E2 to the point D2. The tangent to the second trochoidal curve E2D2 coincides with the tangent to the involute curve B2E2 at the connection point therebetween.

Referring then to FIG. 8, a point A1 and a curve K1 are determined. The point A1 lies on the line M passing through the central points P1, P2 and also on the outer circle C11 on the first screw rotor 13 side. The curve K1 is the trajectory of the point A2 on the outer circle C12 that is described when the first and second screw rotors 13, 14 are rotated. The curve K1 is a trochoidal curve created by rolling the second screw rotor 14 around the first screw rotor 13 with the pitch circle C32 kept in contact with the pitch circle C31. The point A1 corresponds to the aforementioned one end A1 of the tooth top portion A1B1 of the first screw rotor 13. The first trochoidal curve A1C1 in the first screw rotor 13 is formed by the trochoidal curve K1 extending from the point A1 to the point C1 that is the intersection of the trochoidal curve K1 with the inner circle C21.

Similarly, a point A2 and a curve K2 are determined. The point A2 lies on the line M passing through the central points P1, P2 and also on the outer circle C12 on the second screw rotor 14 side. The curve K2 is the trajectory of the point A1 on the outer circle C11 that is described when the first and second screw rotors 13, 14 are rotated. The curve K2 is a trochoidal curve created by rolling the first screw rotor 13 around the second screw rotor 14 with the pitch circle C31 kept in contact with the pitch circle C32. The point A2 corresponds to the aforementioned one end A2 of the tooth top portion A2B2 of the second screw rotor 14. The first trochoidal curve A2C2 in the second screw rotor 14 is formed by the trochoidal curve K2 extending from the point A2 to the point C2 that is the intersection of the trochoidal curve K2 with the inner circle C22.

The tooth top portion A1B1 of the first screw rotor 13 (see FIG. 5) is formed by the arc of the outer circle C11 extending from the point A1 on the first trochoidal curve A1C1 to the point B1 on the involute curve B1E1. The tooth bottom portion C1D1 of the first screw rotor 13 (see FIG. 5) is formed by the arc of the inner circle C21 extending from the point C1 on the first trochoidal curve A1C1 to the point D1 on the second trochoidal curve E1D1. Similarly, the tooth top portion A2B2 and the tooth bottom portion C2D2 of the second screw rotor 14 (see FIG. 5) are formed in substantially the same manner as in the case of the first screw rotor 13.

The point A2 of the second screw rotor 14 is moved along the first trochoidal curve A1C1 of the first screw rotor 13 with the rotation of the first and second screw rotors 13, 14. Then, the point A1 of the first screw rotor 13 is moved along the first trochoidal curve A2C2 of the second screw rotor 14.

In addition, the point B1 of the first screw rotor 13 is moved along the second trochoidal curve E2D2 of the second screw rotor 14 with the rotation of the first and second screw rotors 13, 14. Then, the involute curve B1E1 of the first screw rotor 13 rolls on the involute curve B2E2 of the second screw rotor 14 while being kept in contact therewith. Then, the point B2 of the second screw rotor 14 is moved along the second trochoidal curve E1D1 of the first screw rotor 13.

Referring back to FIG. 3, the tooth profile G21 of the double-threaded portion 26 of the first screw rotor 13 includes a tooth top portion 42A, a tooth bottom portion 43A, a tooth bottom portion 44A, a tooth top portion 45A, a third curved portion 46A formed by a trochoidal curve, a fourth curved portion 47A, and curved portions 48A, 49A. The third curved portion 46A connects one end 422A of the tooth top portion 42A (i.e., one end 461A of the third curved portion 46A) to one end of the tooth bottom portion 43A. The other end 421A of the tooth top portion 42A is connected to the fourth curved portion 47A. The fourth curved portion 47A and the curved portions 48A, 49A are formed by an involute curve and a trochoidal curve. The tooth top portion 42A, the tooth bottom portion 43A, the tooth bottom portion 44A and the tooth top portion 45A are the arcs of the circles the centers of which are the central point P1.

The tooth profile G22 of the double-threaded portion 34 of the second screw rotor 14 includes a tooth top portion 42B, a tooth bottom portion 43B, a tooth bottom portion 44B, a tooth top portion 45B, a third curved portion 46B formed by a trochoidal curve, a fourth curved portion 47B, and curved portions 48B, 49B. The third curved portion 46B connects one end 422B of the tooth top portion 42B (i.e., one end 461B of the third curved portion 46B) to one end of the tooth bottom portion 43B. The other end 421B of the tooth top portion 42B is connected to the fourth curved portion 47B. The fourth curved portion 47B and the curved portions 48B, 49B are formed by an involute curve and a trochoidal curve. The tooth top portion 42B, the tooth bottom portion 43B, the tooth bottom portion 44B and the tooth top portion 45B are the arcs of the circles the centers of which are the central point P2.

The tooth profile G22 of the double-thread portion 34 of the second screw rotor 14 is identical to the tooth profile G21 of the double-thread portion 26 of the first screw rotor 13.

The radii of the tooth top portions 42A, 42B, 45A, 45B in the tooth profiles G21, G22 and of the tooth top portions A1B1, A2B2 in the tooth profiles G11, G12 of the single-thread portions 29, 37 are substantially equal. The radii of the tooth bottom portions 43A, 43B, 44A, 44B in the tooth profiles G21, G22 and of the tooth bottom portions C1D1, C2D2 in the tooth profiles G11, G12 of the single-thread portions 29, 37 are substantially equal.

The third curved portions 46A, 46B formed by a trochoidal curve in the tooth profiles G21, G22 are created in the same manner as in the case of the first curved portions A1C1, A2C2 formed by a trochoidal curve in the tooth profiles G11, G12. The profile of the third curved portions 46A, 46B is identical to the profile of the first curved portions A1C1, A2C2 formed by a trochoidal curve in the tooth profiles G11, G12.

The fourth curved portions 47A, 47B and the curved portions 48A, 48B, 49A, 49B each formed by an involute curve and a trochoidal curve are created in the same manner as in the case of the second curved portions B1D1, B2D2 in the tooth profiles G11, G12 of the single-thread portion 29, 37.

With the rotation of the first and second screw rotors 13, 14, the one end 461B of the third curved portion 46B sweeps along the third curved portion 46A, and the one end 461A of the third curved portion 46A sweeps along the third curved portion 46B. In addition, in accordance with the rotation of the first and second screw rotors 13, 14, the fourth curved portion 47A faces the fourth curved portion 47B, the curved portion 48A faces the curved portion 48B, and the curved portion 49A faces the curved portion 49B.

The tooth profiles G11, G12 of the single-thread portions 29, 37 and the tooth profiles G21, G22 of the double-thread portions 26, 34 thus created are located so that the tooth profile G21 is connected to the tooth profile G11 through the boundary plane 38 and the tooth profile G22 is connected to the tooth profile G12 through the boundary plane 39.

Figure 9A:
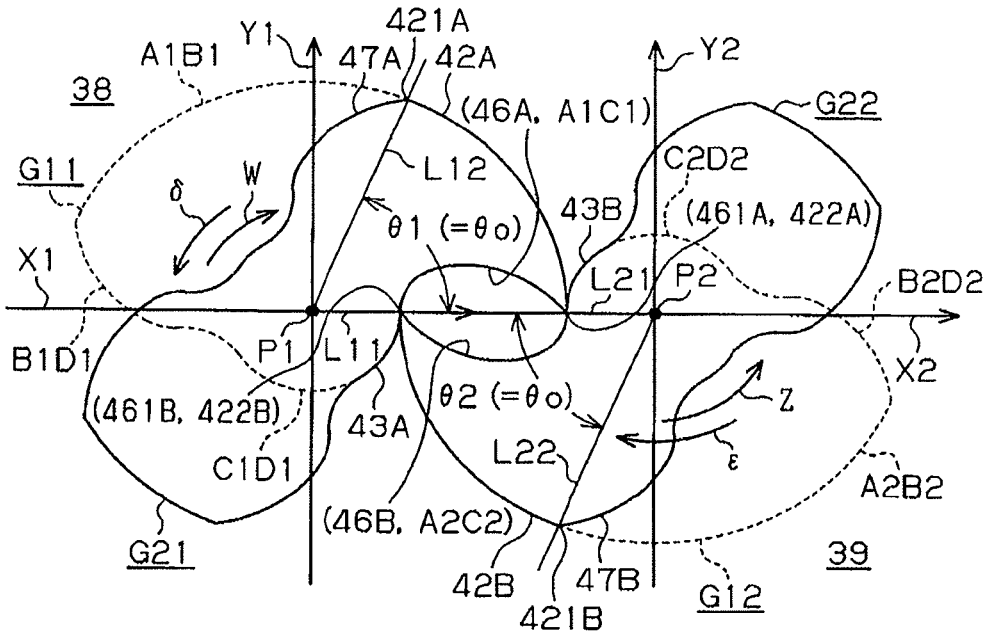
FIGS. 9A to 9C are diagrams showing the tooth profiles of the single-thread portions and the double-thread portions in boundary planes of the first and second screw rotors.

FIG. 9A schematically shows the tooth profiles G21, G22 of the double-thread portions 26, 34 and the tooth profiles G11, G12 of the single-thread portions 29, 37 in the boundary planes 38, 39.

In the following description, the symbol $\alpha 1(\geq 0)$ denotes the difference of angular position about the central point P1 in the boundary plane 38 between the third curved portion 46A (trochoidal curve) of the tooth profile G21 of the double-thread portion 26 and the first curved portion A1C1 (trochoidal curve) of the tooth profile G11 of the single-thread portion 29. In the case of FIG. 9A wherein the angular position of the third curved portion 46A coincides with the angular position of the first curved portion A1C1 about the central point P1 in the boundary plane 38, the difference of angular position $\alpha 1$, that is, the angular difference $\alpha 1$, is zero.

Similarly, In the following description, the symbol $\alpha 2$ ($\geq 0$) denotes the difference of angular position about the central point P2 in the boundary plane 39 between the third curved portion 46B (trochoidal curve) of the tooth profile G22 of the double-thread portion 34 and the first curved portion A2C2 (trochoidal curve) of the tooth profile G12 of the single-thread portion 37. In the case of FIG. 9A wherein the angular position of the third curved portion 46B coincides with the angular position of the first curved portion A2C2 about the central point P2 in the boundary plane 39, the difference of angular position $\alpha 2$, that is, the angular difference $\alpha 2$, is zero.

In the present embodiment, $\alpha 1$ is equal to $\alpha 2$ and, therefore, the angular differences $\alpha 1$, $\alpha 2$ will be hereinafter indicated by the symbol $\alpha o$.

In FIG. 9A, the symbol $\theta 1$ denotes the angle between the line L11 extending from the one end 422A of the tooth top portion 42A to the central point P1 and the line L12 extending from the other end 421A of the tooth top portion 42A to the central point P1. Specifically, the symbol $\theta 1$ denotes the angle between the lines L11 and L12 passing through the respective ends 422A, 421A of the tooth top portion 42A as an arc about the central point P1 in the boundary plane 38. Similarly, the symbol $\theta 2$ denotes the angle between the line L21 extending from the one end 422B of the tooth top portion 42B to the central point P2 and the line L22 extending from the other end 421B of the tooth top portion 42B to the central point P2. Specifically, the symbol $\theta 2$ denotes the angle between the lines L21, L22 passing through the respective ends 422B, 421B of the tooth top portion 42B as an arc about the central point P2 in the boundary plane 39.

In FIG. 9A, $\theta 1$ is equal to $\theta 2$ and, therefore, the angles $\theta 1$, $\theta 2$ will be hereinafter indicated by the symbol $\theta o$.

Figure 9B:
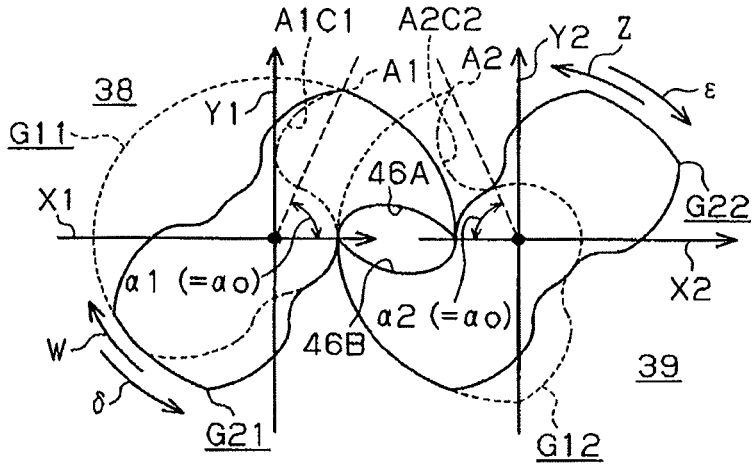

FIG. 9B shows the state where the tooth profile G11 have been shifted from the position of FIG. 9A by being rotated by $\alpha o$ ($<\theta o$) in the direction opposite to the rotation direction W (i.e. thread direction $\delta$) and also shows the state where the tooth profile G12 have been shifted from the position of FIG. 9A by being rotated by $\alpha o$ ($<\theta o$) in the direction opposite to the rotation direction Z (i.e. thread direction $\epsilon$).

Figure 9C:
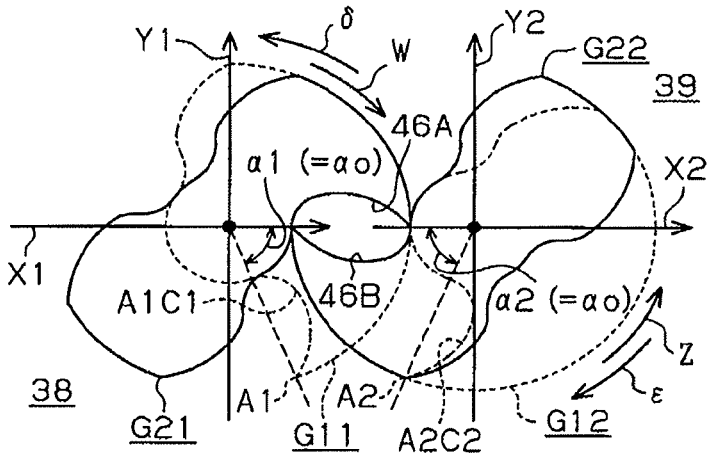

FIG. 9C shows the state where the tooth profile G11 have been shifted from the position of FIG. 9A by being rotated by $\alpha o$ ($<\theta o$) in the rotation direction W (i.e. the direction opposite to the thread direction $\delta$) and also shows the state where the tooth profile G12 have been shifted from the position of FIG. 9A by being rotated by $\alpha o$ ($<\theta o$) in the rotation direction Z (i.e. the direction opposite to the thread direction $\epsilon$).

In the case of FIG. 9A, the first curved portion A1C1 in the boundary plane 38 and the first curved portion A2C2 in the boundary plane 39 satisfy the following condition (1):

(1) The first curved portion A1C1 coincides with the third curved portion 46A in the boundary plane 38, and the first curved portion A2C2 coincides with the third curved portion 46B in the boundary plane 39.

In the case of FIG. 9B, the first curved portion A1C1 in the boundary plane 38 and the first curved portion A2C2 in the boundary plane 39 satisfy the following condition (2):

(2) The first curved portion A1C1 is angularly spaced from the third curved portion 46A by the angular difference $\alpha o$ in the direction opposite to the rotation direction W of the first screw rotor 13 (i.e. in the thread direction $\delta$), and the angular difference $\alpha o<\theta 1$ is satisfied, where $\theta 1$ is the angle (tooth top portion angle) between the line L11 extending from the one end 422A of the tooth top portion 42A to the central point P1 (rotation axis 151) and the line L12 extending from the other end 421A of the tooth top portion 42A to the central point P1 in the boundary plane 38. The first curved portion A2C2 is angularly spaced from the third curved portion 46B by the angular difference $\alpha o$ in the direction opposite to the rotation direction Z of the second screw rotor 14 (i.e. in the thread direction $\epsilon$), and the angular difference $\alpha o<\theta 2$ is satisfied, where $\theta 2$ is the angle (tooth top portion angle) between the line L21 extending from the one end 422B of the tooth top portion 42B to the central point P2 (rotation axis 161) and the line L22 extending from the other end 421B of the tooth top portion 42B to the central point P2 in the boundary plane 39.

Figure 10:
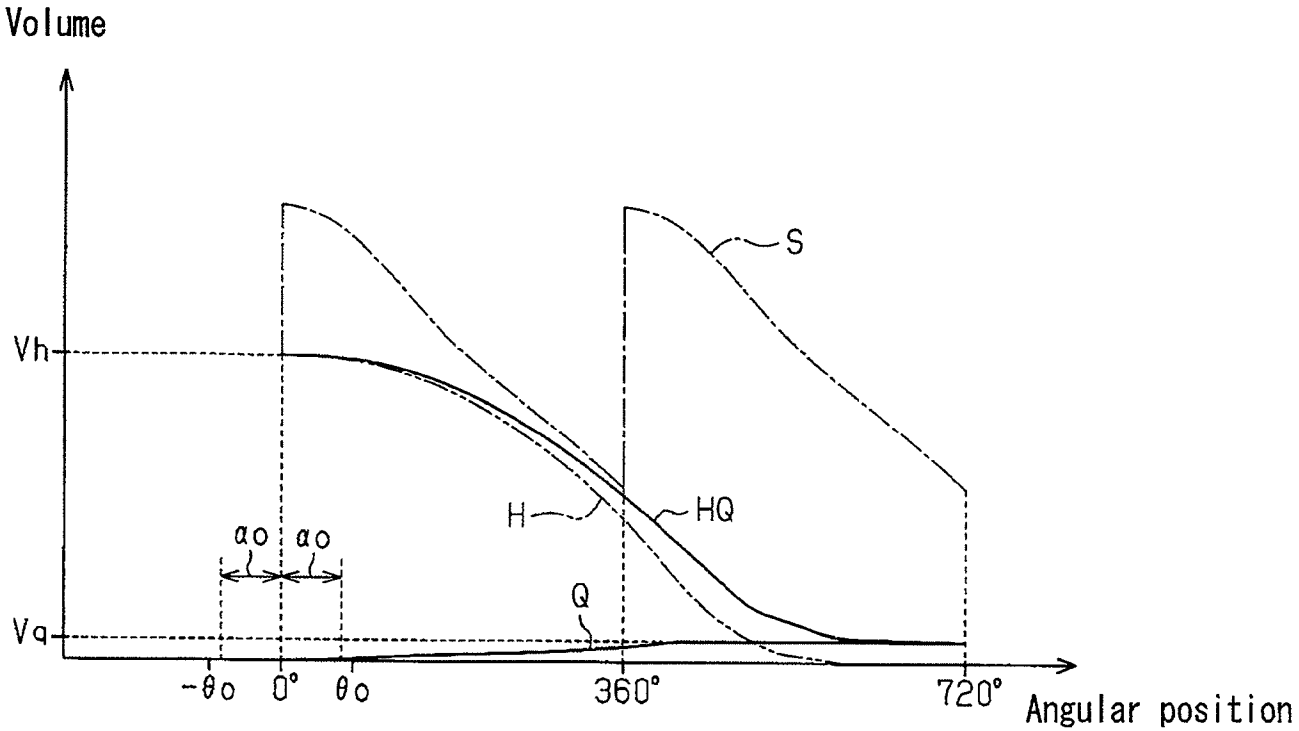
FIG. 10 is a graph showing the change of the fluid transfer volume by the screw pump.

If the above condition (1) or (2) is satisfied, the volume V1 of the helical grooves of the double-thread portions 26, 34 located upstream of and adjacent to the boundary planes 38, 39 is changed as indicated by the curve H in FIG. 10 with the rotation of the first and second screw rotors 13, 14.

In FIG. 10, the horizontal axis represents the angular position of the first and second screw rotors 13, 14, and the vertical axis represents the fluid volume. FIGS. 9A, 9B, 9C show the state where the angular position of the first and second screw rotors 13, 14 is 0 degree in FIG. 10.

When the first and second screw rotors 13, 14 are rotated two complete turns from the angular position of 0 degree (0 to 720 degree), the volume V1 indicated by the curve H converges from its maximum Vh to zero without increasing.

If the condition (1) is satisfied, the volume V2 of the helical grooves of the single-thread portions 29, 37 located downstream of and adjacent to the boundary planes 38, 39 is changed as indicated by the curve Q in FIG. 10 with the rotation of the first and second screw rotors 13, 14. When the first and second screw rotors 13, 14 are rotated two complete turns from the angular position of 0 degree (0 to 720 degree), the volume V2 indicated by the curve Q increases gradually and then converges to a predetermined value that is the volume of the helical grooves of the single-thread portions 29, 37 away from the boundary planes 38, 39 (hereinafter referred to as Vq). If the condition (2) is satisfied, on the other hand, the change of the volume V2 with the rotation of the first and second screw rotors 13, 14 is delayed by $\alpha o$ relative to the curve Q in FIG. 10. That is, the volume V2 is changed in accordance with the curve that is shifted by $\alpha o$ rightward in FIG. 10 from the position of the curve Q. The fluid transfer volume (V1+V2), which is the sum of the volumes V1 and V2, is changed as indicated by the curve HQ in FIG. 10. When the first and second screw rotors 13, 14 are rotated two complete turns from the angular position of 0 degree (0 to 720 degree), the fluid transfer volume (V1+V2) indicated by the curve HQ converges to the maximum volume Vq on the curve Q without increasing.

If neither the condition (1) nor (2) is satisfied, for example, when the tooth profile G11 have been shifted from the position of the FIG. 9A by being rotated by $\alpha o$ ($<\theta o$) in the rotation direction W (i.e. the direction opposite to the thread direction $\delta$), as shown in FIG. 9C, the fluid transfer volume (V1+V2) is changed as indicated by the curve S in FIG. 10 with the rotation of the first and second screw rotors 13, 14.

This is because the helical groove of the single-thread portion 29 located downstream of and adjacent to the boundary plane 38 is not connected to the helical groove of the double-thread portion 26 within the range of $-\alpha o$ to 0 degree. When the helical groove of the single-thread portion 29 is connected to the helical groove of the double-thread portion 26 at 0 degree, the fluid transfer volume is increased rapidly by the volume of the helical groove of the single-thread portion 29 connected to the helical groove of the double-thread portion 26.

Figure 11A:
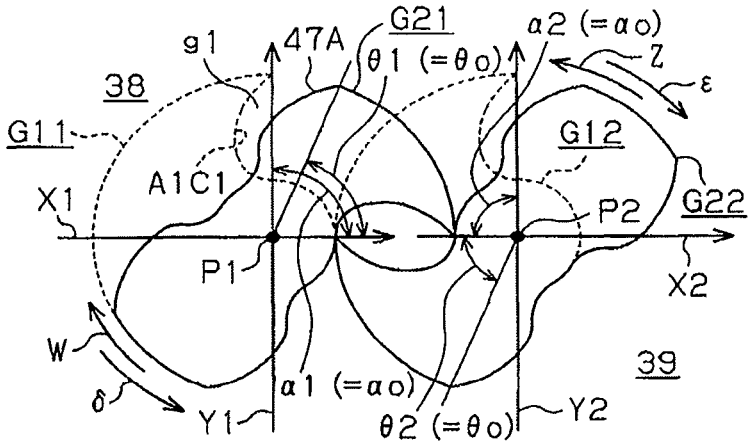
FIGS. 11A and 11B schematically show the tooth profiles of the single-thread portions and the double-thread portions in the boundary planes.

FIG. 11A shows the state where there exists a gap g1 between the fourth curved portion 47A of the tooth profile G21 of the double-thread portion 26 and the first curved portion A1C1 of the tooth profile G11 of the single-thread portion 29 in the boundary plane 38. In such a case, due to the presence of the gap g1, two different fluid transfer spaces adjacent to the third curved portion 46A, which is formed by the helical groove 24 of the double-thread portion 26 adjacent to the boundary plane 38, are connected with each other through the helical groove 28 of the single-thread portion 29 adjacent to the boundary plane 38. That is, two different fluid transfer spaces located upstream and downstream of the third curved portion 46A are connected.

Figure 11B:
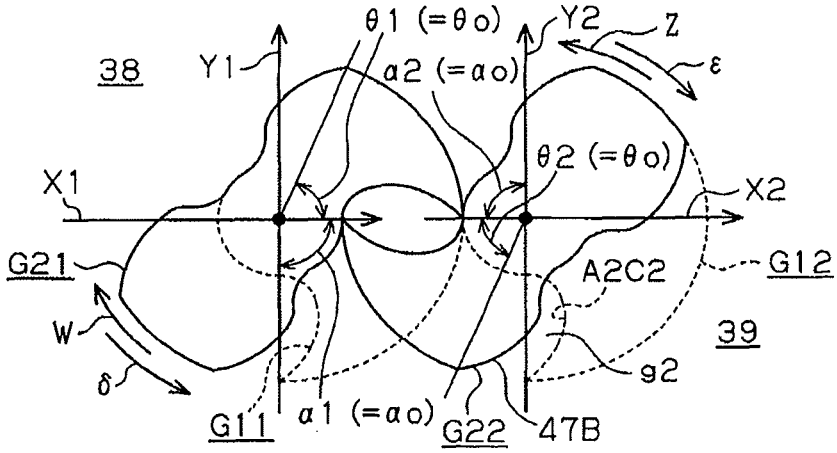

FIG. 11B shows the state where there exists a gap g2 between the fourth curved portion 47B of the tooth profile G22 of the double-thread portion 34 and the first curved portion A2C2 of the tooth profile G12 of the single-thread portion 37 in the boundary plane 39. In such a case, due to the presence of the gap g2, two different fluid transfer spaces adjacent to the third curved portion 46B, which is formed by the helical groove 32 of the double-thread portion 34 adjacent to the boundary plane 39, are connected with each other through the helical groove 36 of the single-thread portion 37 adjacent to the boundary plane 39. That is, two different fluid transfer spaces located upstream and downstream of the third curved portion 46B are connected.

The presence of such gaps g1, g2 causes rapid increase and decrease in the fluid transfer volume, as shown by the curve S in FIG. 10. In addition, the gaps g1, g2 may be generated depending on the combination of the profiles of the fourth curved portions 47A, 47B and the number of threads in the multiple-thread portion even when the condition $\alpha o<\theta o$ is satisfied. In such a case, the combination is limited to the one that does not cause such g1, g2.

The first and second screw rotors 13, 14 according to the first embodiment offer the following advantages.

(1) The first curved portions A1C1, A2C2 satisfy the condition (1) or (2). Accordingly, when the first and second screw rotors 13, 14 are rotated two complete turns from the angular position of 0 degree (0 to 720 degree), the fluid transfer volume (V1+V2) indicated by the curve HQ in FIG. 10 converges to the maximum volume Vq on the curve Q without increasing. That is, when the first and second screw rotors 13, 14 are rotated two complete turns from the angular position of 0 degree (0 to 720 degree), the volume of the helical grooves adjacent to the boundary planes 38, 39 converges to the maximum volume Vq on the curve Q without increasing. This contributes to preventing inefficient pumping operation of the screw pump 11 while maintaining a good rotational balance of the screw rotors 13, 14 and ensuring sealing performance.

(2) When dimensional error of the tooth profiles G11, G12, G21, G22 is large and the condition $\alpha o=\theta o$ is satisfied, the gaps g1, g2 may be generated as shown in FIGS. 11A and 11B. However, the present embodiment wherein the condition $\alpha o<\theta o$ is satisfied prevents generation of the gaps g1, g2. Accordingly, when the first and second screw rotors 13, 14 are rotated two complete turns from the angular position of 0 degree (0 to 720 degree), the fluid transfer volume (V1+V2) reliably converges to the maximum volume Vq on the curve Q in FIG. 10 without increasing.

(3) The second curved portions B1D1, B2D2 in the first and second screw rotors 13, 14 are formed by composite curves that are formed by the involute curves B1E1, B2E2 and the second trochoidal curves E1D1, E2D2, respectively. The use of such composite curves allow the of the second curved portions B1D1, to be shortened, thereby allowing an increased circumferential length of the tooth top portions A1B1, A2B2 and the tooth bottom portions C1D1, C2D2 and hence allowing increased angles $\beta 1$, $\beta 2$. Such increased circumferential length of the tooth top portions A1B1, A2B2 allows an increased axial length of the crests 271, 351 (see FIG. 1) along the rotation axes 151,161, thereby increasing the axial sealing length between the crests 271, 351 and the inner peripheral surface of the rotor housing 12. This prevents fluid leakage between the crests 271, 351 and the inner peripheral surface of the rotor housing 12.

The above embodiment may be modified in various ways as exemplified below.

Figure 12:
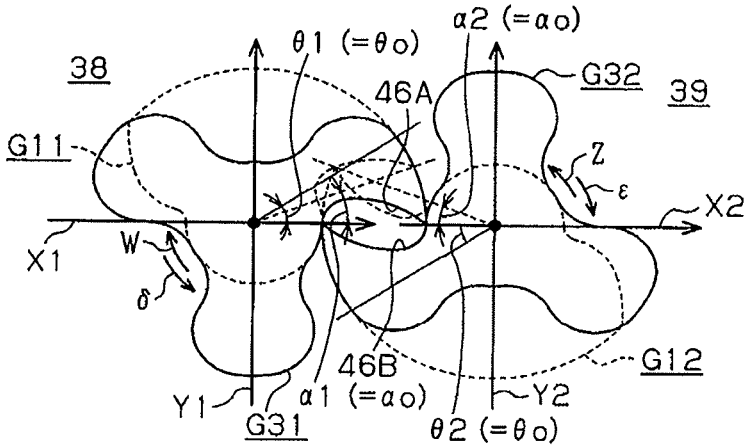
FIG. 12 schematically shows tooth profiles of the first and second screw rotors according to a second embodiment of the present invention.

The present invention is applicable to a screw rotor having single-thread portion with tooth profiles such as G11, G12 and multiple-thread portions, or triple-thread portions with tooth profiles G31, G32 as shown in FIG. 12. It is noted that the tooth profiles G31, G32 are substantially identical to those disclosed in Japanese Examined Patent Application Publication No. 63-59031. The tooth profiles G31, G32 include third curved portions 46A, 46B formed by a trochoidal curve. The tooth profiles G31, G32 of the multiple-thread portions and the tooth profiles G11, G12 of the single-thread portions satisfy the conditions (1) or (2) described above.

The second curved portions B1D1, B2D2, the fourth curved portions 47A, 47B and the curved portions 48A, 48B, 49A, 49B may be formed by a curve based on a circular arc other than involute curve and trochoidal curve.

The present invention is applicable to a screw rotor including a single-thread portion and a multiple-thread portion the number of threads of which is four or more.

What is claimed is:

1. A screw rotor for use in a screw pump that pumps fluid by rotation, the screw rotor comprising:

a multiple-thread portion having multiple helical teeth and multiple helical grooves for a pump suction side; and a single-thread portion having only one helical tooth and only one helical groove for a pump discharge side, wherein the single-thread portion has a tooth profile in a plane that is perpendicular to a rotation axis of the screw rotor, the tooth profile of the single-thread portion including:

a tooth top portion spaced a radial distance from the rotation axis and extending in an arcuate manner around the rotation axis;

a tooth bottom portion spaced a radial distance from the rotation axis and extending in an arcuate manner around the rotation axis, the radial distance from the rotation axis to the tooth bottom portion being smaller than the radial distance from the rotation axis to the tooth top portion;

a first curved portion defined by a trochoidal curve, the first curved portion connecting a first end of the tooth top portion to a first end of the tooth bottom portion; and a second curved portion connecting a second end of the tooth top portion to a second end of the tooth bottom portion, wherein the multiple-thread portion has a tooth profile in a plane that is perpendicular to the rotation axis of the screw rotor, the tooth profile of the multiple-thread portion including:

a tooth top portion spaced a radial distance from the rotation axis and extending in an arcuate manner around the rotation axis;

a tooth bottom portion spaced a radial distance from the rotation axis and extending in an arcuate manner around the rotation axis, the radial distance from the rotation axis to the tooth bottom portion being smaller than the radial distance from the rotation axis to the tooth top portion;

a third curved portion defined by a trochoidal curve, the third curved portion connecting a first end of the tooth top portion to a first end of the tooth bottom portion; and a plurality of curved portions connecting a second end of the tooth top portion to a second end of the tooth bottom portion, wherein a tooth top portion angle, θ, is defined between a line extending from the first end of the tooth top portion of the multiple-thread portion to the rotation axis and a line extending from the second end of the tooth top portion of the multiple-thread portion to the rotation axis, wherein the screw rotor is configured such that the tooth profile of the multiple-thread portion is connected to the tooth profile of the single-thread portion through a boundary plane that is perpendicular to the rotation axis, and wherein the first curved portion satisfies one of a first condition and a second condition:

in the first condition, the first curved portion of the single-thread portion is aligned with the third curved portion of the multiple-thread portion in the boundary plane such that the first end of the tooth top portion of the single-thread portion coincides with the first end of the tooth top portion of the multiple-thread portion; and in the second condition, the first curved portion of the single-thread portion and the third curved portion of the multiple-thread portion are angularly spaced in a direction opposite to a rotation direction of the screw rotor in the boundary plane by an angular difference, αo, where the angular difference $\alpha o<\theta$ is satisfied.

2. The screw rotor of claim 1, wherein a number of threads of the multiple-thread portion is one of two and three.

3. A screw pump comprising the screw rotor of claim 1, wherein the screw rotor is a pair of screw rotors that rotate in opposite directions to each other.

4. The screw rotor of claim 1, wherein a profile of the first curved portion is identical to a profile of the third curved portion.

5. The screw rotor of claim 1, wherein the second curved portion is defined by a composite curve that is defined by an involute curve and a trochoidal curve.

* * * * *